US009235172B2

(12) United States Patent
Imaizumi et al.

(10) Patent No.: US 9,235,172 B2
(45) Date of Patent: Jan. 12, 2016

(54) IMAGE FIXING APPARATUS

(71) Applicant: CANON KABUSHIKI KAISHA, Tokyo (JP)

(72) Inventors: Toru Imaizumi, Kawasaki (JP); Takashi Narahara, Mishima (JP); Atsutoshi Ando, Yokohama (JP); Yasuhito Minamishima, Odawara (JP); Masafumi Maeda, Yokohama (JP); Tomoya Tateishi, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/336,270

(22) Filed: Jul. 21, 2014

(65) Prior Publication Data

US 2015/0023704 A1 Jan. 22, 2015

(30) Foreign Application Priority Data

Jul. 22, 2013 (JP) ..... 2013-151617
Jun. 23, 2014 (JP) ..... 2014-128147

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053; G03G 2215/2035; G03G 15/2017
See application file for complete search history.

(56) References Cited

U.S. PATENT DOCUMENTS 7,177,579 B2 2/2007 Uchida et al.
7,209,696 B2 4/2007 Umezawa et al.
7,283,145 B2 10/2007 Kato et al.
7,366,455 B2 4/2008 Iwasaki et al.
7,389,079 B2 6/2008 Narahara et al.

(Continued)

FOREIGN PATENT DOCUMENTS

JP 5-289555 A 11/1993
JP 6-348156 A 12/1994

(Continued)

OTHER PUBLICATIONS

Japanese Office Action dated Oct. 6, 2015 in counterpart Japanese Application No. 2014-128147.

*Primary Examiner* — Rodney Bonnette
(74) *Attorney, Agent, or Firm* — Fitzpatrick, Cella, Harper & Scinto

(57) ABSTRACT

A fixing device for fixing a toner image formed on a sheet includes a cylindrical film; a heater having a first surface contacting an inner surface of the film; an opposed member forming a press-contact portion with the film therebetween; a supporting member for supporting a second surface of the heater opposite the first surface; and a heat conduction member contacting the second surface. In a generatrix direction of the film, an end portion of a contact region between the heat conduction member and the second surface is at or inside an end portion of the press-contact portion. In a region from an end portion of the contact region to an outside of an end portion of the press-contact portion with respect to the direction, the supporting member includes a first region not contacting the second surface and a second region contacting the second surface outside the first region.

10 Claims, 11 Drawing Sheets

(56) References Cited

U.S. PATENT DOCUMENTS

| | | | | |
|---|---|---|---|---|
| 7,428,390 | B2 | 9/2008 | Ando | |
| 7,469,120 | B2 | 12/2008 | Iwasaki et al. | |
| 7,512,370 | B2 | 3/2009 | Shimizu et al. | |
| 7,570,895 | B2 | 8/2009 | Ando et al. | |
| 7,792,448 | B2 | 9/2010 | Ando et al. | |
| 8,331,819 | B2 | 12/2012 | Fukuzawa et al. | |
| 8,670,702 | B2 | 3/2014 | Ikegami et al. | |
| 8,712,303 | B2 | 4/2014 | Ando et al. | |
| 8,744,296 | B2 | 6/2014 | Fukuzawa et al. | |
| 2006/0233575 | A1* | 10/2006 | Uchida et al. | 399/329 |
| 2007/0116502 | A1 | 5/2007 | Shimizu et al. | |
| 2008/0292375 | A1 | 11/2008 | Tsai et al. | |
| 2009/0220288 | A1* | 9/2009 | Omata | 399/333 |
| 2013/0011157 | A1* | 1/2013 | Kaino et al. | 399/92 |
| 2013/0028622 | A1 | 1/2013 | Nihonyanagi et al. | |
| 2013/0272762 | A1 | 10/2013 | Uekawa et al. | |
| 2014/0138372 | A1* | 5/2014 | Ogura | 219/216 |
| 2014/0186078 | A1 | 7/2014 | Imaizumi et al. | |

FOREIGN PATENT DOCUMENTS

| | | | |
|---|---|---|---|
| JP | 8-339131 | A | 12/1996 |
| JP | 10-189218 | A | 7/1998 |
| JP | 11-084919 | A | 3/1999 |
| JP | 11-260533 | A | 9/1999 |
| JP | 2000-206811 | A | 7/2000 |
| JP | 2002-260506 | A | 9/2002 |
| JP | 2003-317898 | A | 11/2003 |
| JP | 2007-058195 | A | 3/2007 |
| JP | 2008-292981 | A | 12/2008 |

* cited by examiner (a)

(b)

IMAGE FIXING APPARATUS

FIELD OF THE INVENTION AND RELATED ART

The present invention relates to an image fixing apparatus (image heating apparatus) which is desirable as a fixing device to be mounted in an image forming apparatuses such as an electrophotographic copying machine, an electrophotographic laser beam printer, etc.

There are various fixing apparatuses (devices) which are mountable in an electrophotographic copying machine, an electrophotographic copying machine, and the like. One of them has been known as a fixing device of the heating film type. A fixing device of the heating-film type has a heater, a film, a pressure roller, etc. The heater has a ceramic substrate, and a heat generating resistor placed on the substrate. The film is cylindrical and rotates in contact with the heater. The pressure roller forms a nip by sandwiching the film between itself and the heater. In operation, a sheet of a recording medium, on which an unfixed toner image is present, is conveyed through the nip while being heated. Thus, the toner image on the sheet of a recording medium is thermally fixed to the sheet.

One of the merits which a fixing device of the heating-film type has is that it is relatively short in the length of time it takes for its temperature to rise to a level at which fixation is possible, after power begins to be supplied to its heater. Thus, a printer which employs a fixing device of the heating film is relatively short in the length of time (FPOT: First Print Out Time) it takes for the printer to output the first image after the inputting of a print start command. Another merit which a fixing device of this type has is that it is small in the amount of electrical power it consumes while it is kept on standby for a print start command.

By the way, it has been known that as a substantial number of small prints are continuously outputted by a printer having a fixing device of the heating-film type, with the same chronological intervals as that for large prints, the out-of-sheet-path portion of the heater, that is, the portion of the heater, which is outside the sheet path, excessively increases in temperature. As the out-of-sheet-path portion of the heater excessively increases in temperature (out-of-sheet-path temperature increase), the components, such as the pressure roller, of the fixing device sometimes are thermally damaged. Thus, it is desired that a printer, which employs a fixing device of the heating-film type, is structured so that when it is used for continuously outputting a substantial number of small prints, it is widened in print interval, compared to when it is used for continuously outputting a substantial number of large prints, in order to prevent the out-of-sheet-path portion of the heater from excessively increasing in temperature.

However, a widening print interval reduces the output of the image forming apparatus, that is, the print count per unit length of time. Thus, it is desired to make the output (print count per unit length of time) of a printer having a fixing device of the heating-film type when a substantial number of small prints are continuously outputted, the same as that when a substantial number of large prints are continuously outputted.

Referring to FIG. 11, Japanese Laid-open Patent Application H11-84919 discloses a heating apparatus (device) having a metallic plate 14*a* between its heater 12 and a thermally insulative supporting member 11. With the placement of the metallic plate 14*a*, which is a thermally conductive member, between thermally insulative member 11 and the heater 12, it is possible to prevent the problem that the heater becomes non-uniform in temperature. In other words, it is possible to reduce the difference in temperature between the portion of the heater, which is outside the recording medium path (out-of-sheet-path portion), and the portion of the heater, which is within the recording medium path (sheet-path portion), which occurs as the "out-of-sheet-path temperature increase" occurs. However, if the metallic plate 14*a* is long enough to extend from one end of the heater to the other as shown in FIG. 11, the end portions of the sheet-path portion of the heater, in terms of the direction parallel to the generatrix of the film, are reduced in temperature, and therefore, the portions of the film, which correspond to the end portions of the sheet-path portion of the heater, are reduced in temperature, which possibly will cause an image forming apparatus to output images which are unsatisfactory in fixation.

Japanese Laid-open Patent Application H11-84919 proposes also a fixing device which is provided with multiple metallic plates 14*a*. In the case of this fixing device, the metallic plates 14*a* are fitted in the recesses of the thermally insulative member 11.

SUMMARY OF THE INVENTION

According to an aspect of the present invention, there is provided a fixing device for fixing a toner image formed on a recording material, on a recording material, the fixing device comprising a cylindrical film; a heater having a first surface contacting an inner surface of the film; an opposed member cooperating with the heater to form a press-contact portion with the film interposed therebetween; a supporting member for supporting a second surface of the heater opposite the first surface; and a heat conduction member contacting the second surface. With respect to a generatrix direction of the film, an end portion of a contact region between the heat conduction member and the second surface is at or inside an end portion of the press-contact portion. In a region from an end portion of the contact region to an outside of an end portion of the press-contact portion with respect to the generatrix direction, the supporting member includes a first region not contacting the second surface and a second region contacting the second surface outside the first region.

Further features of the present invention will become apparent from the following description of exemplary embodiments (with reference to the attached drawings).

BRIEF DESCRIPTION OF THE DRAWINGS

FIG. 5(*b*) is a plan view of the supporting member as seen from the side of its surface to which the thermally conductive member is attached; and FIG. 5 (*c*) is a drawing for illustrating the positional relationship among the supporting member, the thermally conductive member, the heater, the film, and the pressure roller of the fixing device, in the adjacencies of one of the lengthwise end of the pressure roller.

FIG. 6(*b*) is a drawing for illustrating the direction in which heat conducts through the heater and thermally conductive member, in the adjacencies of one of their lengthwise ends.

FIG. 7(*b*) is a drawing for illustrating the clip.

FIG. 8(*b*) is a drawing for illustrating the state of contact between the heater and the thermally conductive member of a comparative fixing device, in the adjacencies of one of the lengthwise ends of the thermally conductive member.

FIG. 12(*b*) is a sectional view of the combination of the pressure stay, the supporting member, the thermally conductive member, and the heater, of the fixing device in the first embodiment, at a plane which is perpendicular to the lengthwise direction of the fixing device and corresponds in position to the center of the fixing device in terms of the lengthwise direction of the fixing device.

DESCRIPTION OF THE PREFERRED EMBODIMENTS

Hereinafter, the present invention is described in detail with reference to appended drawings. The preferable embodiments of the present invention, which will be described hereafter, are some of the most preferable of the embodiments of the present invention. However, they are not intended to limit the present invention in scope. That is, the present invention is also applicable, within the gist of the present invention, to various known image heating apparatuses (devices) which are different in structure from those in the following embodiments.

Embodiment 1

In this embodiment, an image heating apparatus in accordance with the present invention is described as a fixing apparatus (fixing device) of the heating-film type, which is mountable in an image forming apparatus such as a printer, a copying machine, and the like, which is based on electrophotographic recording technologies.

(1) Structure of Fixing Device 30

Figure 1:
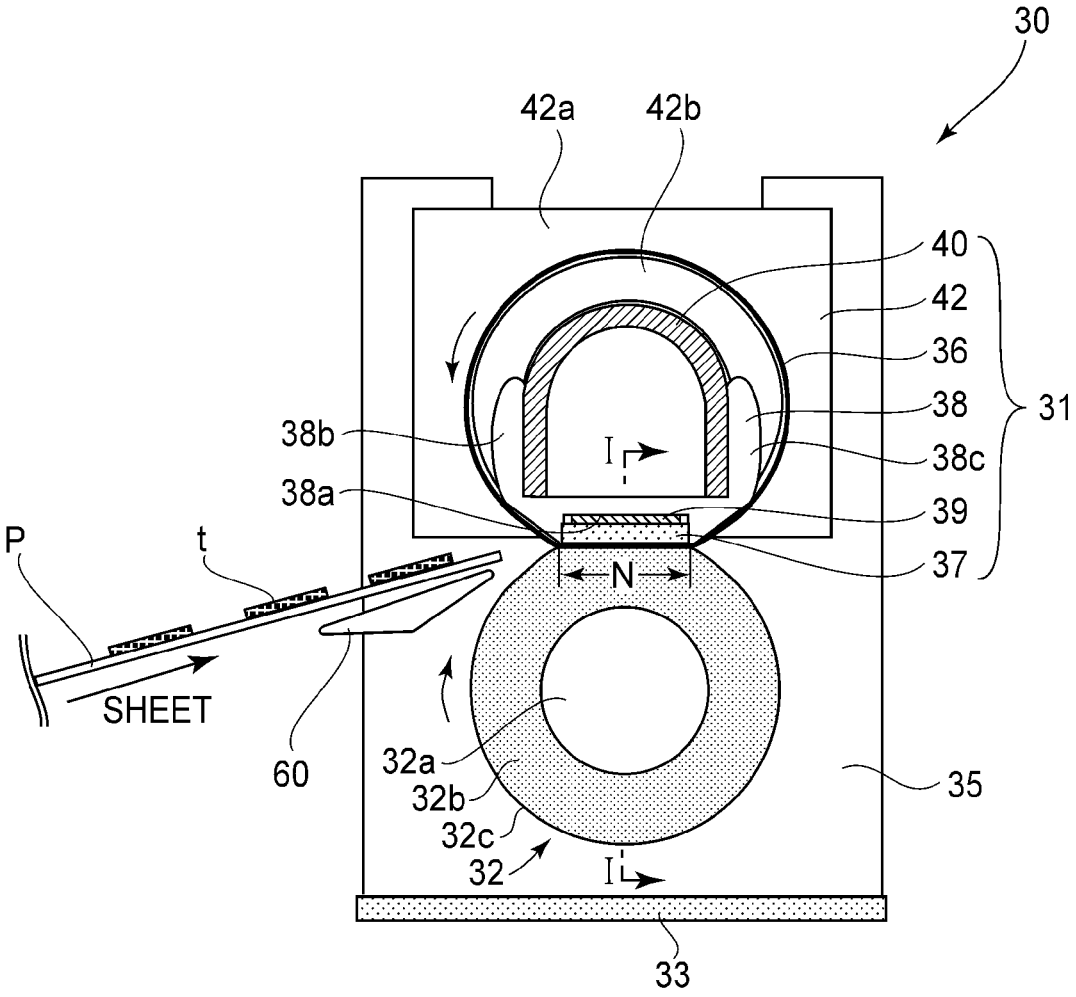
FIG. 1 is a sectional view of the fixing device in the first embodiment of the present invention, at a vertical plane which is perpendicular to the lengthwise direction of the fixing device and coincides in position to the center of the fixing device in terms of the lengthwise direction of the fixing device.
Figure 2:
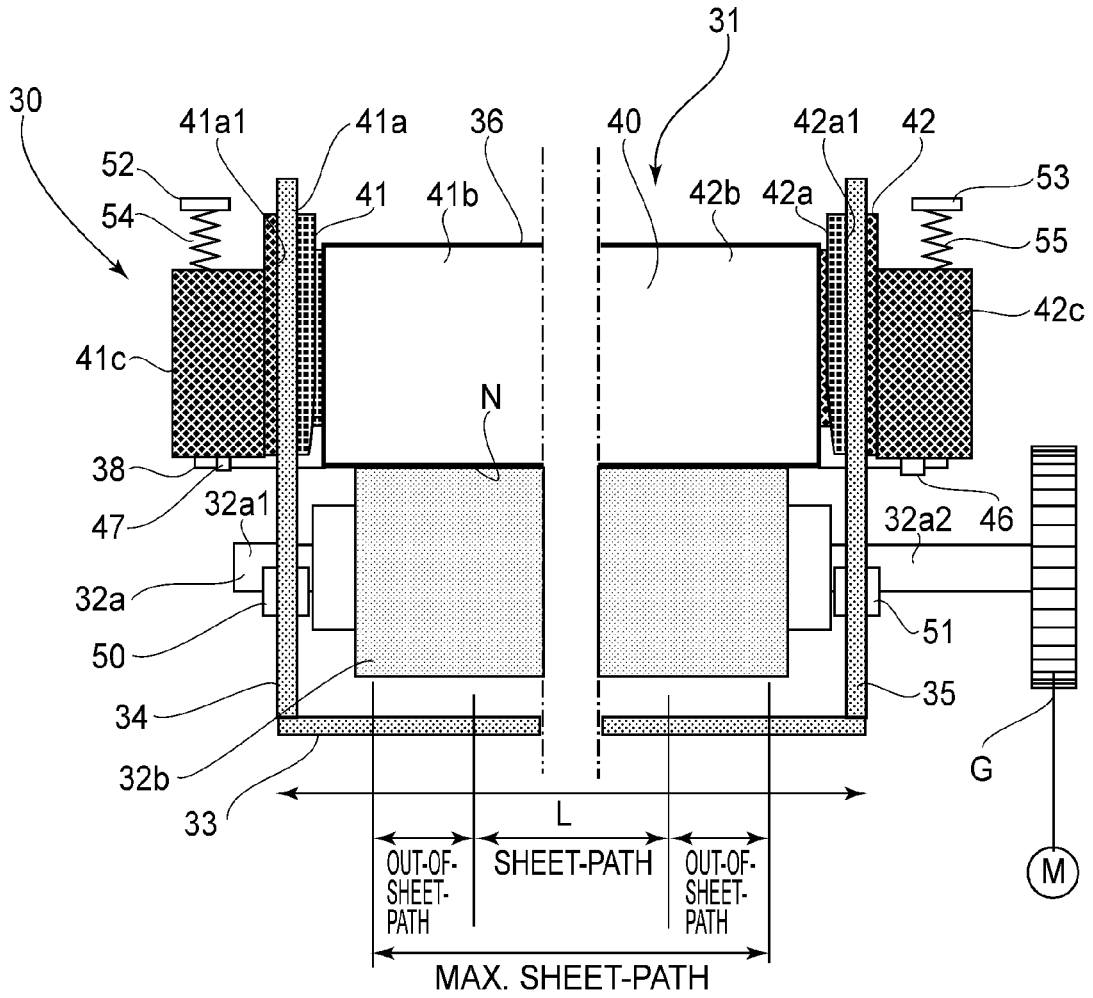
FIG. 2 is a front view of the fixing device (minus its center portion in terms of its lengthwise direction) in the first embodiment.
Figure 3:
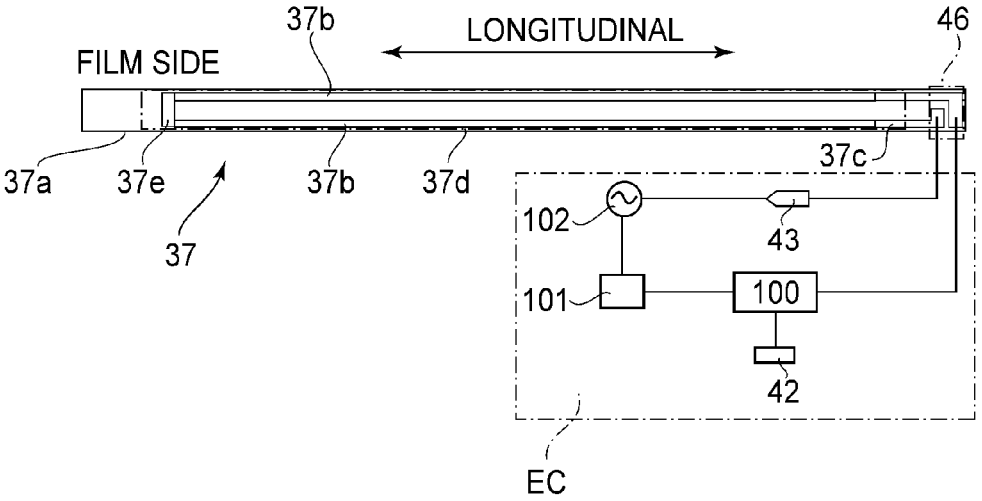
FIG. 3 is a plan view of the heater of the fixing device in the first embodiment, as seen from the side of its surface on which the heating film slides.
Figure 4:
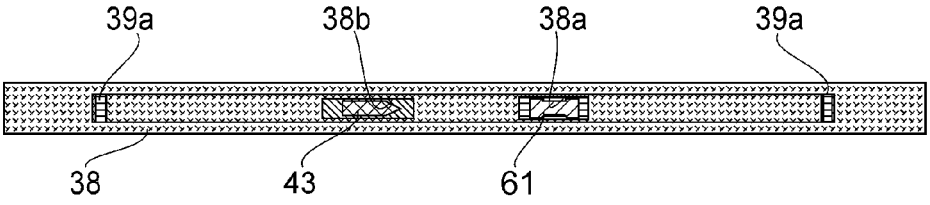
FIG. 4 is a drawing for showing the positional relationship among the supporting member, thermally conductive member, thermistor, and temperature fuses of the fixing device in the first embodiment.

FIG. 1 is a sectional view of the fixing device 30 in this embodiment, at a plane which is perpendicular to the lengthwise direction of the fixing device 30 and corresponds in position to the center of the fixing device 30 in terms of the lengthwise direction of the fixing device 30. FIG. 2 is a front view of the fixing device 30 (minus its center portion in terms of its lengthwise direction) of the fixing device in this embodiment. In FIG. 2, for the sake of descriptive discretion, the film 36 is drawn as if it is transparent, and the components which are within the hollow of the film 36 and are contoured with solid lines, along with the lateral plates 34 and 35 of the frame 33. FIG. 3 is a front view of the heater 37 as seen from its side on which the film slides. FIG. 4 is a drawing which shows the positional relationship among the supporting member 38, the thermally conductive member 39, the thermistor 61, and the temperature fuse 43.

Fixing device 30 has a film unit 31, and a pressure roller 32 as a pressure applying member. The film unit 31 has: a cylindrical film 36 as a cylindrical rotational member; the heater 37, as a heating member, which is in the form of a piece of plate; and a supporting member 38 which supports the heater 37. Further, the film unit 31 has: a thermally conductive member 39 which is between the heater 37 and supporting member 38; a pressure stay 40 as a reinforcing member for reinforcing the supporting member 38; and a pair of flanges 41 and 42, as regulating members, which regulate the film 36 in terms of the movement in the lengthwise direction of the fixing device 30.

The pressure roller 32, the film 36, the heater 37, the supporting member 38, the thermally conductive member 39, and the pressure stay 40 are disposed so that their lengthwise direction becomes perpendicular to the recording medium conveyance direction. The film 36 is disposed in parallel to the pressure stay 32. The heater 37, the supporting member 38, the thermally conductive member 39, and the pressure stay 40 are disposed within the hollow of the film 36. The flanges 41 and 42 are disposed at the lateral edges of film 36, one for one.

The shape of the supporting member 38 is such that its cross-section at a plane parallel to the direction (which hereafter may be referred to as widthwise direction) parallel to the recording medium conveyance direction is roughly semicircular (FIG. 1). It is rigid, heat resistant, and thermally insulative. The material for the supporting member 38 is a liquid polymer resin. The pressure roller 32 side of the supporting member 38 is provided with a groove 38*a*, which extends in the lengthwise direction of the supporting member 38. It is in this groove 38*a* that the thermally conductive member 39 and the heater 37 are fitted, being thereby supported by the supporting member 38. Further, the opposite surface of the supporting member 38 from the pressure roller 32 is provided with a pair of guiding portions 38*b* and 38*c*, which are roughly arc-shaped and are on the upstream and downstream sides, respectively, in terms of the recording medium conveyance direction. It is by these guiding portions 38*b* and 38*c* that the film 36 is properly held while the film 36 is rotated.

The pressure stay (reinforcing member) 40 is used for increasing the film unit 31 in rigidity (resistance to bending). It is formed by bending a long piece of stainless steel, which is 1.6 mm in thickness, in such a manner that its cross section at a plane parallel to the widthwise direction of the fixing device 30 becomes shaped like a letter U. The pressure stay 40 is disposed between the guiding portions 38*b* and 38*c* of the supporting member 38.

Referring to FIG. 3, the heater 37 has a substrate 37*a*, the lengthwise direction of which is parallel to the generatrix of the film 36. The "direction of the generatrix of the film 36" means the direction indicated by an arrow mark L in FIG. 2. It is the same as the above-described lengthwise direction of the fixing device 30. The material for the substrate 37*a* is a ceramic such as alumina, aluminum nitrate, etc. The heater 37 has also a pair of long and narrow heat generating members 37*b*, which are on the surface (which hereafter may be referred to as film sliding surface) of the substrate 37*a*, which faces inward of the film loop. Each heat generating resistor 37*b* is formed of silver/palladium alloy or the like, by screen printing or the like. It extends in the lengthwise direction of the substrate 37*a*.

Further, the film unit 31 is provided with a pair of electrical contacts 37*c*, which are on the film sliding surface of the substrate 37*a*. The electrical contacts 37*c* are in contact with the pair of heat generating resistors 37*b*, one for one. The heat generating resistors 37*b* are connected in series through an electrically conductive pattern 37*e* formed of silver or the like.

Further, film unit 31 is provided with a gloss coat 37*d*, as a protective layer, which covers each heat generating resistor 37*b*, the electrically conductive pattern 37*e*, and a part of each electrical contact 37*c*, which are on the film sliding surface of the substrate 37*a*. Not only does the glass coat 37*d* protect the heat generating resistors 37*b*, but also, reduces the friction between the inward surface of the film 36 and the heater 37.

The above-mentioned heater 37 is fitted in the groove 38*a* of the supporting member 38 so that it extends in the direction parallel to the generatrix of the film 36, and also, so that the heater 37 contacts the film 36 by its glass coat 37*d*.

The substrate 37*a* of the heater 37 is in the form of a rectangular parallelepiped. It is 270.0 mm in length, 5.8 mm in width, and 1.0 mm in thickness. The material for the substrate 37*a* is alumina. The dimension of the heat generating resistor 37*b* in terms of the lengthwise direction is 22.0 mm. Each heat generating resistor 37*b* is 18Ω in electrical resistance.

Referring to FIG. 4, the supporting member 38 is provided with a pair of through holes 38*a* and 38*b*, which are in the adjacencies of the lengthwise center of the supporting member 38. It is in the through hole 38*a* that a thermistors 61, as a temperature detection element, is disposed. It is in the through hole 38*b* that a temperature fuse 43, as a circuit breaking element, is disposed in contact with the thermally conductive member 39. That is, the thermistor 61 and the temperature fuse 43 are in contact with the thermally conductive member 39 so that the heat from the heater 37 is sensed by the thermistor 61 and the temperature fuse 43 through the thermally conductive member 39.

In order to stabilize the thermistor 61 in the state of contact between the thermistor 43 and heater 37, the thermistor 61 is disposed with the placement of a piece of ceramic paper or the like between its housing and the heater 37, and is covered with a piece of dielectric tape such as a piece of polyamide tape.

The temperature fuse 43 is such a component that detects the abnormal heat generation of the heater 37, based on the abnormal temperature increase of the heater 37, and interrupts the power supply to the heater 37. It has a cylindrical metallic housing, and a fusible element which melts at a preset temperature and is disposed in the cylindrical metallic housing. As the fusible element of the temperature fuse 43 is melted away by the abnormal temperature increase of the heater 37, the temperature fuse 43 interrupts the power supply to an electrical circuit EC (FIG. 3) for supplying the heater 37 with electrical power. The temperature fuse 43 is attached to the thermally conductive member 39 with the placement of thermally conductive grease between itself and thermally conductive member 39, in order to prevent the malfunction of the fixing device 30, which is attributable to the separation of the temperature fuse 43 from the heater 37.

The film 36 is loosely fitted around the combination of the supporting member 38 (which supports the heater 37), the thermally conductive member 39, and the pressure stay 40. The film 36 has: a cylindrical substrate; an elastic layer formed on the peripheral surface of the substrate; and a parting layer formed on the outward surface of the elastic layer. The film 36 in this embodiment is 18.0 mm in internal diameter. The substrate is 60 μm in thickness, and is formed of polyamide. The elastic layer is roughly 150 μm in thickness, and is formed of silicone rubber. The parting layer is 15 μm in thickness, and is formed of a piece of PFA resin tube.

The material for the flanges 41 and 42 is liquid polymer resin. The flange 41 has a plate-like regulating portion 41*a* (FIG. 2) which regulates the film 36 in terms of the movement in the lengthwise direction of the fixing device 30. More specifically, as the film 36 deviates in the lengthwise direction of the fixing device 30, it comes into contact with the regulating portion 41*a*, being thereby preventing from deviating further. The regulating portion 41*a* supports the pressure stay 40 and the supporting member 38 at one of the lengthwise ends of the fixing device 30. It has a pair of vertical grooves 41*a*1, which are in its upstream and downstream end surfaces, respectively. The lateral plate 34 (one of lateral plates) of the frame 33 is fitted in this vertical groove 41*a*1, making it possible for the flange 41 to move relative to the pressure roller 32.

The flange 41 has also an arc-like guide portion 41*b*, which is in the surface of the regulating portion 41*a*, which faces the inward surface of the film 36. Not only does the guide portion 41*b* support the pressure stay 40 and the supporting member 38 at one of the lengthwise ends of the fixing device 30, but also, guides the film 36 with its outward surface, as the film 36 is rotationally moved. Moreover, the flange 41 has a spring seat 41*c*, which is a part of the outward surface of the regulating portion 41*a*, that is, the opposite surface of the flange 41 from the film 36.

Further, the flange 41 has also a plate-like regulating portion 42*a* (FIG. 2) which regulates the deviation of the film 36 in the lengthwise direction of the fixing device 30. That is, as the film 36 deviates in the lengthwise direction of the fixing device 30, it comes into contact with the regulating portion 42*a*, being thereby prevented from deviating further. The regulating portion 42*a* supports the pressure stay 40 and the supporting member 38 at the other end of the fixing device 30. The regulating portion 42*a* is provided with a pair of vertical grooves 42*a*1, which are in the upstream and downstream surfaces of the regulating portion 42*a*, in terms of the recording medium conveyance direction. The other lateral plate 35 of the frame 33 is fitted in this vertical groove 42*a*1, making it possible for the flange 42 to be moved relative to the pressure roller 32.

Further, the flange 42 has an arc-like guide portion 42*b*, which is in the surface of the regulating portion 42*a*, which faces the inward surface of the film 36. Not only does this guide portion 42*b* support the pressure stay 40 and the supporting member 38 at one of the lengthwise ends of the fixing device 30, but also, guides the film 36 with its outward surface, as the film 36 is rotationally moved. Moreover, the flange 42 has a spring seat 42*c*, which is a part of the outward surface of the regulating portion 41*a*, that is, the opposite surface of the regulating portion 41*a* from the film 36.

The pressure roller 32 has a metallic core 32*a*, an elastic layer 32*b*, and a parting layer 32*c*. The elastic layer 32*b* covers the peripheral surface of the metallic core 32*a*, except for the shaft portions 32*a*1 and 32*a*2 of the metallic core 32*a*, that is, the lengthwise end portions of the metallic core 32*a*. The parting layer 32*c* covers the outward surface of the elastic layer 32*b*. The material for the elastic layer 32*b* is silicone rubber, fluorinated rubber, or the like. The material for the parting layer 32*c* is PFA (tetrafluoroethylene, perfluoroalkylvinylether copolymer), PTFE (polytetrafluoroethylene), FEP (tetrafluoroethylene/hexafluoropropylene copolymer), or the like.

The structure of the pressure roller 32 in this embodiment is as follows: It has metallic core 32*a*, an elastic layer 32*b* as the first elastic member layer, and a parting layer 32*c*. The metallic core 32*a* is formed of stainless steel, and is 11.0 mm in external diameter. The elastic layer 32*b* covers the virtual entirety of the peripheral surface of the metallic core 32*a*. The parting layer 32*c* covers the outward surface of the elastic layer 32*b*. More specifically, the elastic layer 32*b* is silicone rubber layer formed on the peripheral surface of the metallic core 32*a* to a thickness of roughly 3.5 mm, by injection molding. The parting layer 32*b* is roughly 40 μm in thickness, and is formed by covering the elastic layer 32*b* with a piece of PFA resin tube.

The pressure roller 32 is 18.0 mm in external diameter. From the standpoint of formation of a satisfactory nip N, and also, durability, the hardness (measured by ASKER-C hardness gauge, under 9.8 N of weight) of the pressure roller 32 is desired to be in a range of 40°-70°. In this embodiment, the hardness of the pressure roller 32 is 54°. The length of the elastic layer 32*b* of the pressure roller 32 is 226.0 mm.

Referring to FIG. 2, the shaft portions 32*a*1 and 32*a*2 of the metallic core 32*a* of the pressure roller 32 are rotatably supported by the lateral plates 34 and 35, with the placement of a pair of bearings 50 and 51 between the shaft portions 32*a*1 and 32*a*2 and the lateral plates 34 and 35, respectively. A driving gear G is fixed to the shaft portion 32*a*2.

Figure 12:
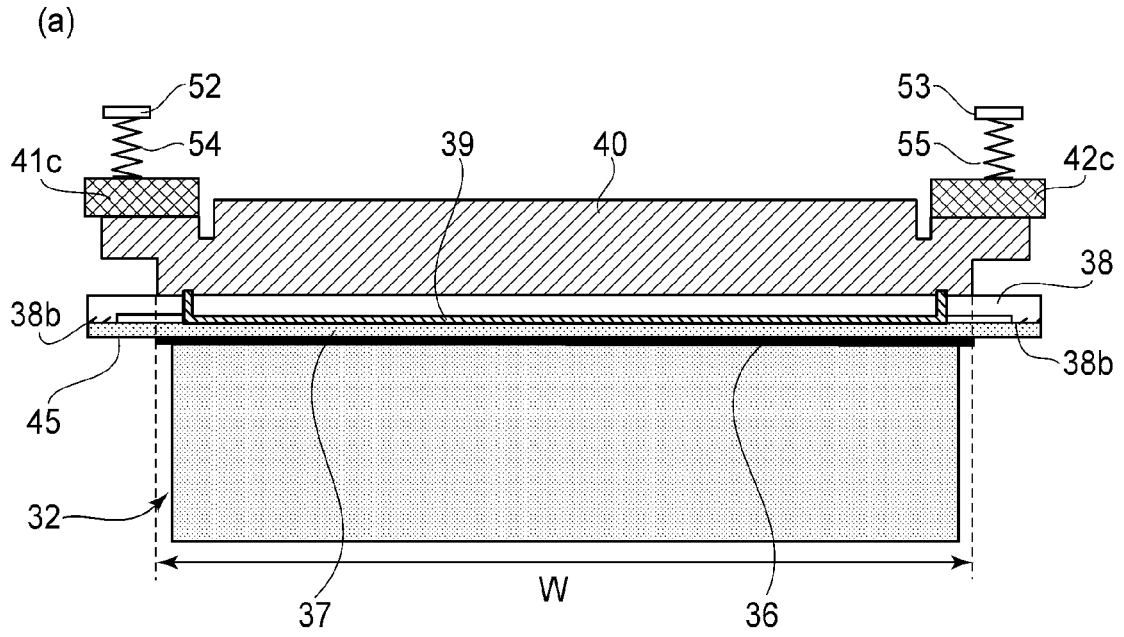
FIG. 12(*a*) is a drawing illustrating the structure of the pressure stay, the supporting member, the thermally the conductive member, the heater, and the flange, of the fixing device in the first embodiment, as seen from the direction parallel to the recording medium conveyance direction.
Figure 12:
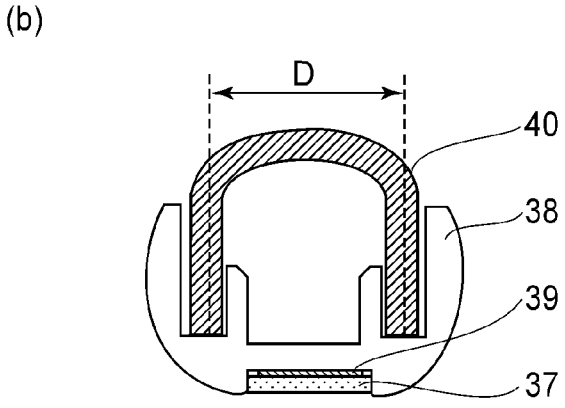

FIG. 12(*a*) shows the pressure stay 40, the supporting member 38, the thermally conductive member 39, the heater 37, the spring seat 41*c* of the flange 41, and the spring seat portion 42*c* of the flange 42, as seen from the recording medium conveyance direction. It shows the structure of the fixing device 30. The spring seating portions 41*c* and 42*c* are under the pressure generated by a pair of compression springs 54 and 55 disposed between themselves and a pair of pressure application arms 52 and 53, respectively, in the vertical direction, which is perpendicular to the generatrix of the film 36. The spring seat portions 41*c* and 42*c* transmit the force they receive from the compression springs 54 and 55, to the supporting member 38 through the pressure stay 40. The supporting member 38 presses the heater 37 against the peripheral surface of the pressure roller 32, with the presence of the thermally conductive member 39 between itself and the heater 37, and the film 36 between the heater 37 and the peripheral surface of the pressure roller 32, forming thereby the nip N (FIG. 1).

The pressure stay 40 is in contact with the supporting member 38 across the entirety of the supporting member 38 in terms of the lengthwise direction. The lengthwise ends of the area of contact between the pressure stay 40 and supporting member 38 are on the outward side of the lengthwise ends of the nip N.

The supporting member 38 makes no contact, except for its contact with the opposite surface of the heater 37 from the surface of the heater 37, which is in contact with the film 36, and its contact with the film 36 by its contacting surface 38*b*. FIG. 12(*b*) is a cross-sectional view of the combination of the pressure stay 40, supporting member 38 (minus the contacting surface 38*b*), the thermally conductive member 39, and the heater 37, at a plane perpendicular to the lengthwise direction. Referring to FIG. 12(*b*), the fixing device 30 is structured so that the supporting member 38 makes no contact with the heater 37, except for its contact with the heater 37. This structural arrangement can improve the state of contact between the thermally conductive member 39 and the heater 37.

In this embodiment, the total contact pressure between the surface of the pressure roller 32 and the surface of the film 36 is 180 N, and the width of the nip N is roughly 6.2 mm. Further, the inward surface of the film 36 is coated with heat resistant grease, to reduce the friction between the film 36 and the heater 37, and also, the friction between the film 36 and the supporting member 38.

(2) Thermally Fixing Operation of Fixing Device 30

The rotational force of the output shaft of the motor M is transmitted to the driving gear G, whereby the pressure roller 32 is rotated in the direction indicated by an arrow mark in FIG. 1. Thus, the film 36 is rotated by the rotation of the pressure roller 32 in the direction indicated by an another arrow mark in FIG. 1, sliding on the heater 37, with the inward surface of the film 36 sliding on the glass coat layer 37*d* of the heater 37.

As a control portion 100 (FIG. 3) made up of a CPU and memories such as a RAM, a ROM, and the like, turns on a triac 101, electric power is supplied from a commercial power source 102 to the heat generating resistor 37*b* of the heater 37 through the power supply connector 46, which will be described later. Consequently, the heat generating resistor 37*b* generates heat, increasing thereby the heater in temperature. The triac 101 is controlled by the control portion 100 so that the temperature detected by the thermistor 61 for monitoring the temperature of the substrate 37*a* remains a preset fixation temperature (target level).

A sheet P of a recording medium (FIG. 1) on which an unfixed toner image t is present is introduced into the nip N while being guided by an entrance guide 60. In the nip N, the heat from the heater 37, and the pressure in the nip N, are applied to the toner image t on the sheet P while the sheet P is conveyed, remaining pinched by the pressure roller 32 and the film 36, through the nip N. Consequently, the toner image t is thermally fixed to the sheet P. After the fixation of the toner image t to the sheet P, the sheet P is discharged from the nip N. The dimension (width) of the widest sheet P, in terms of the lengthwise direction, which is conveyable through the fixing device 30 in this embodiment is 216.0 mm.

(3) Position of Lengthwise End of Pressure Roller 32, Heater 37, Thermally Conductive Member 39, and Supporting Member 38

Figure 5:
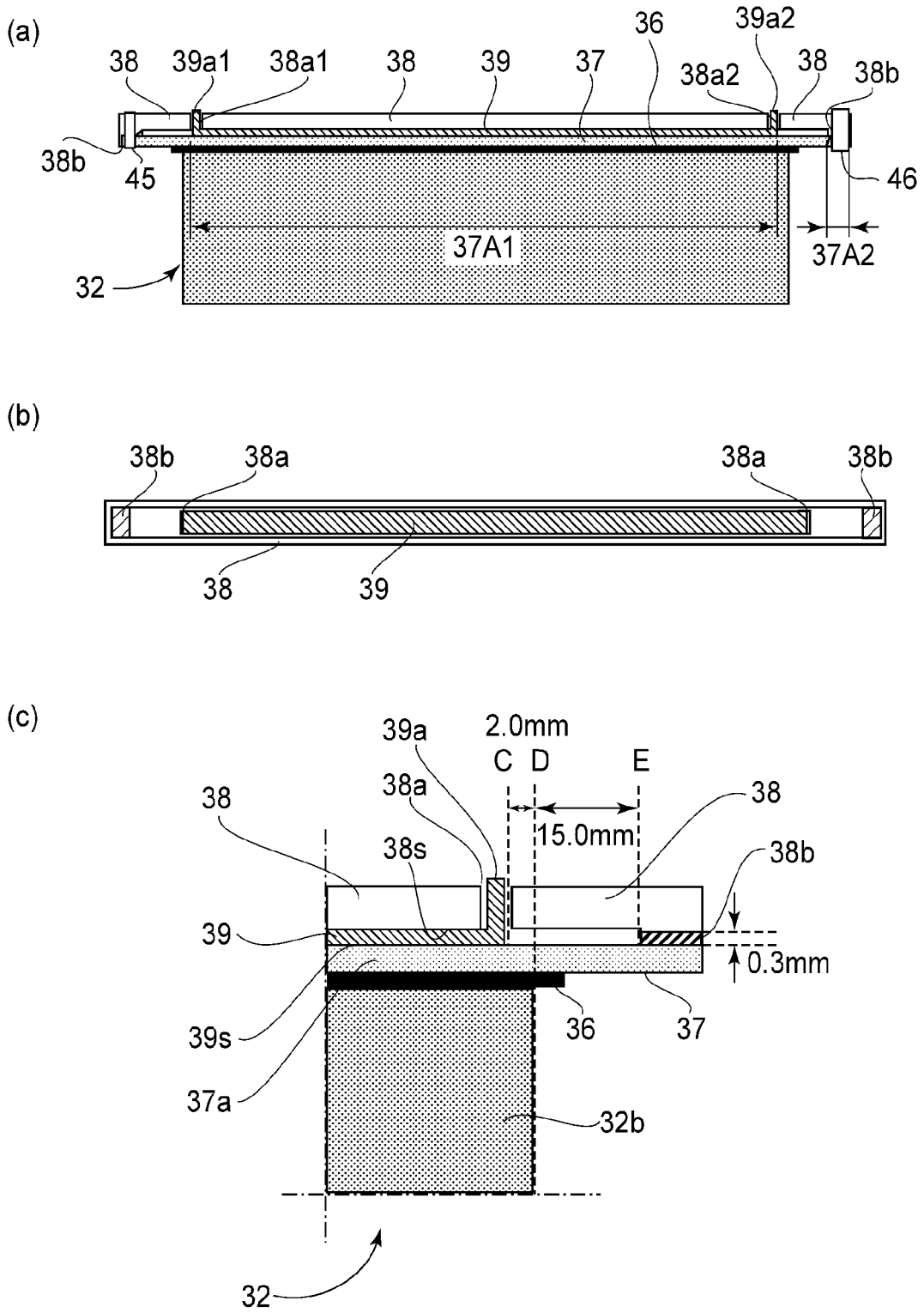
FIG. 5(*a*) is a sectional view of the fixing device in the first embodiment, at a plane indicated by a pair of arrow marks I in FIG. 1.

Next, referring to FIG. 5, the characteristic features of the fixing device 30 in this embodiment are described in detail. FIG. 5(*a*) is a sectional view of the fixing device 30 at a plane I-I, as seen from the direction indicated by a pair of arrowheads. FIG. 5(*b*) is a plan view of the supporting member 38, as seen from the heater 37 side, after the attachment of the thermally conductive member 39 to the supporting member 38. FIG. 5(*c*) is a drawing for illustrating the positional relationship among the supporting member 38, the thermally conductive member 39, the heater 37, the film 36, and the pressure roller 32, at one of their lengthwise end portions. In FIG. 5(*a*), the power supply connector 46 and clip 47 are contoured with a solid line, for descriptive discretion. In FIG. 5(*b*), the power supply connector 46 is not shown, for descriptive discretion.

Hereafter, the surface of the heater 37, which is in contact with the film 36, will be referred to as the first surface, whereas the opposite surface of the heater 37 from the first surface will be referred to as the second surface. Referring to FIG. 5(*c*), the fixing device 30 is structured so that, in terms of the direction parallel to the generatrix of the film 36, the end C of the portion of the thermally conductive member 39, which is in contact with the second surface of the heater 37, is on the inward side of the end D of the nip N. Further, the fixing device 30 is structured so that the inward end E of the surface 38*b* (second surface) of the supporting member 38, which is in contact with the second surface of the heater 37, is on the outward side of the end D of the nip N. Further, the fixing device 30 is structured so that the area (first area) of the supporting member 38, which is between the end C and end E does not contact the second surface of the heater 37. The end D of the nip N coincides in position with the end of the pressure roller 32.

The thermally conductive member 39 in this embodiment is a piece of aluminum plate which is uniform in thickness. It is 0.3 mm in thickness. From the standpoint of minimizing the out-of-sheet-path temperature increase, that is, the phenomenon that when a substantial number of small prints are continuously outputted, the out-of-sheet-path portions of the heater 37 excessively increases in temperature, the area of contact between the thermally conductive member 39 and the heater 37 is desired to be no less in length than the heat generating resistor 37*b* of the heater 37. However, in consideration of the temperature drop which occurs across the lengthwise end portions of the sheet-path portion (FIG. 2) of the heater 37, the length of the area of contact between the thermally conductive member 39 and the heater 37 is desired not to be excessive.

Regarding the shape of the area of contact between the thermally conductive member 39 and the heater in this embodiment, the area of contact is straight and rectangular. The length of the area of contact in terms of the direction parallel to the generatrix of the film 36 is 222.0 mm which is the same as the length of the heat generating resistor 37*b* of the heater 37, and the width of the area of contact in terms of the direction perpendicular to the generatrix of the film 36 is 5.0 mm. Since the pressure roller 32 is 226.0 mm in length, the lengthwise end C of the thermally conductive member 39 is on the inward side of the end D by 2.0 mm.

The thermally conductive member 39 has a pair of bent portions 39*a*1 and 39*a*2, which are at the ends of the thermally conductive member 39, one for one, in terms of the direction parallel to the generatrix of the film 36. The bent portions 39*a*1 and 29*a*2 are inserted into, and remain in, a pair of holes 38*a*1 and 38*a*2, with which the end portions of the supporting member 38, in terms of the direction parallel to the generatrix of the film 36, is provided. The holes 38*a*1 and 38*a*2 are for absorbing the difference in coefficient of linear expansion between the thermally conductive member 39 and the supporting member 38, and are made slightly larger in size than the bent portions 39*a*1 and 39*a*2. As the material for the thermally conductive member 39, not only a metallic substance such as aluminum and copper, but also, graphite, which are higher in thermal conductivity than the substrate 37*a* of the heater 37, can be used.

At this time, the role of the thermally conductive member 39 is described. The role of the thermally conductive member 39 is to keep the heater 37 uniform in temperature to prevent the problem that as the out-of-sheet-path temperature increase occurs due to the continuous outputting of a substantial number of small prints, such components as the heater 37, the film 36, the supporting member 38, the pressure roller 32, etc., of the fixing device 30 are thermally damaged.

Figure 6:
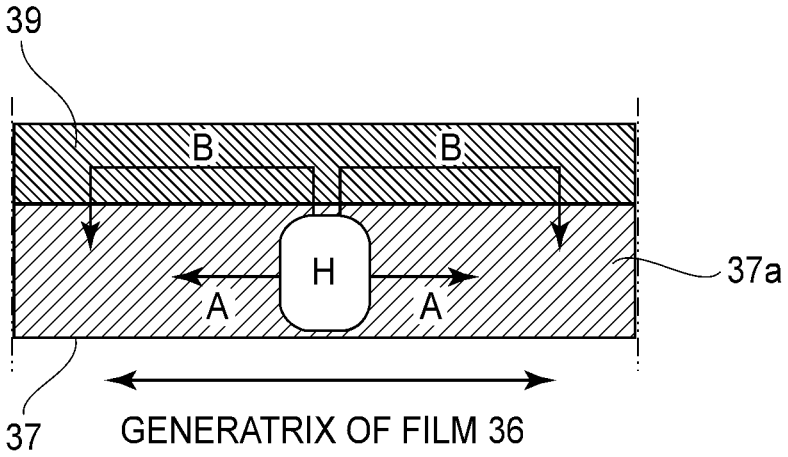
FIG. 6(*a*) is a drawing for illustrating the direction in which heat conducts through the heater and thermally conductive member.
Figure 6:
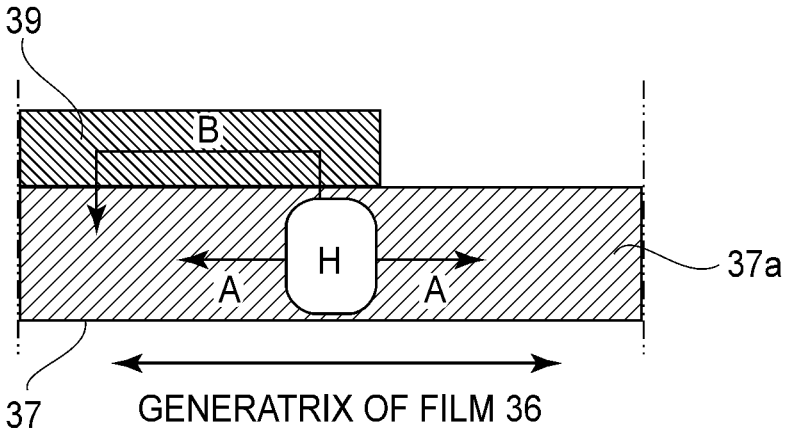

Next, referring to FIG. 6, how the heater 37 is kept uniform in temperature is described. FIG. 6(*a*) is a drawing for illustrating the heat flow through the heater 37 and the thermally conductive member 39 in terms of the direction parallel to the generatrix of the film 36. FIG. 6(*b*) is for illustrating the heat flow in the lengthwise end portion of the heater 37 and that of the thermally conductive member 39.

Alumina, which is used as the material for the substrate 37*a* of the heater 37, is roughly 26 W/mK in thermal conductivity. In comparison, aluminum, which is used as the material for the thermally conductive member 39, is roughly 230 W/mK, which is higher than that of the substrate 37*a*.

Let's think about a case in which a portion H of the substrate 37*a*, in terms of the direction parallel to the generatrix of the film 36, became higher in temperature than the rest of the substrate 37*a*. In such a case, heat flows not only in the substrate 37*a* in the direction indicated by an arrow mark A, which is parallel to the generatrix of the film 36, but also, from the substrate 37*a* to the thermally conductive member 39 through the area of contact between the substrate 37*a* and the thermally conductive member 39. Further, the heat having flowed into the thermally conductive member 39 flows in the thermally conductive member 39 in the direction indicated by the stem portion of arrow marks B, which is parallel to the generatrix of the film 36 to return to the substrate 37*a*. Thus, the heater 37 is made uniform in heat (temperature) by this circular flow of heat, whereby the out-of-sheet-path temperature increase is minimized.

However, the heater 37 is made uniform in heat (temperature) even when the largest sheets of the recording medium, in terms of the direction perpendicular to the recording medium conveyance direction, are conveyed (which hereafter may be referred to as widest sheet P). Thus, if the thermally conductive member 39 is made long enough to extend into the portions of the heater 37, which do not contact the film 36, heat is likely to escape from the area of the heater 37, which has the heat generating resistor 37*b*, to the area of the heater 37, which does not have the heat generating resistor 37*b*. Thus, it is possible that when sheets P of the recording medium, which are the same in width as the sheet passage of the fixing device 30, are conveyed through the nip N, the portions of toner image, which correspond in position to the lateral edge portions of the sheet, will be unsatisfactorily fixed.

Referring to FIG. 6(*b*), in a case where only the portions of the heater 37, which correspond to the adjacencies of the lengthwise end of the thermally conductive member 39, become high in temperature, heat primarily flows toward only one end (left end in FIG. 6(*a*)) since the thermally conductive member 39 is on only one side (left side). That is, it is unlikely for heat to escape to an area other than where the thermally conductive member 39 is present. Therefore, the out-of-sheet-path temperature increase can be minimized, while preventing the temperature decrease of the end portions of the sheet-path portion of the heater 37, by structuring the fixing device 30 so that the thermally conductive member 39 is on the inward side of the end D of the pressure application area of the pressure roller 32, instead of across the entirety of the area of contact between the substrate 37*a* of the heater 37 and the film 36.

Figure 7:
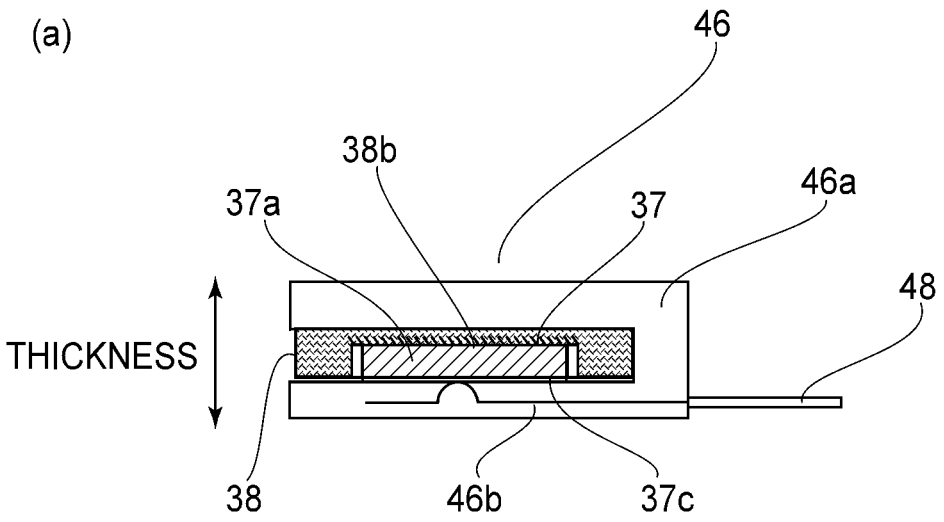
FIG. 7(*a*) is a drawing for illustrating the power supply connector.
Figure 7:
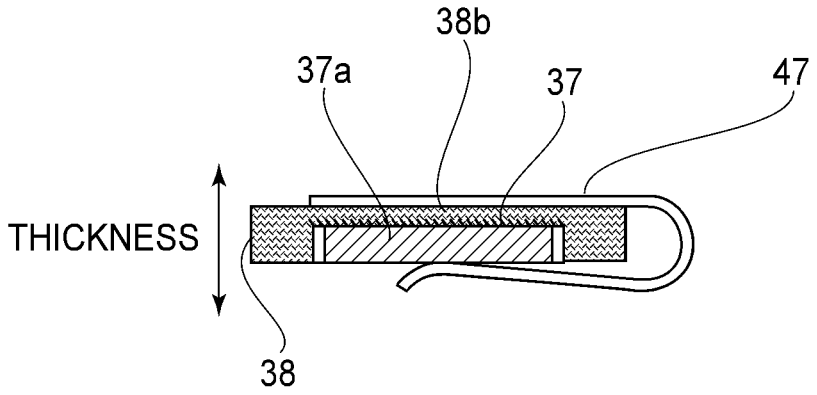

Next, referring to FIG. 7, the power supply connector 46 and clip 47 as holding members are described about their structure. FIG. 7(*a*) is a drawing for illustrating the power supply connector 46, and FIG. 7(*b*) is a drawing for illustrating the clip 47.

In this embodiment, the heater 37 is held to the supporting member 38, by both of its lengthwise ends, in terms of the direction parallel to the generatrix of the film 36, with the use of the power supply connector 46 or the clip 47.

Referring to FIG. 7(*a*), the power supply connector 46 has a housing 46*a* and a contact terminal 46*b*. The housing 46*a* is U-shaped, and is formed of a resinous substance. It sandwiches the heater 37 and the supporting member 38 from the outward side of the combination of the heater 37 and the supporting member 38, preventing thereby the end portions of the heater 37, in terms of the direction parallel to the generatrix of the film 36, from moving in the thickness direction of the heater 37. As for the contact terminal 46*b*, it is an integral part of the housing 46*a*. It elastically contacts the electrical contact 37*c* of the heater 37, establishing electrical contact between itself and the heater 37, while maintaining a present amount of contact pressure between itself and the heater 37. Further, it is in contact with a wire bundle 48, which is in contact with an unillustrated commercial power supply and triac.

In this embodiment, the contact terminal 46*b* of the power supply connector 46 is an integral part of the housing 46*a* of the contact terminal 46*b*. However, the power supply connector 46 may be structured so that its housing and contact terminal are physically independent from each other.

Next, referring to FIG. 7(*b*), the clip 47 is shaped like a letter U, and is formed of a piece of a metallic plate. It elastically sandwiches the combination of the heater 37 and the supporting member 38, from the outward side of the combination to prevent the lengthwise end portions of the heater 37, in terms of the direction parallel to the generatrix of the film 36, from moving in the thickness direction of the heater 37.

Further, the power supply connector 46 and the clip 47 are for regulating both of the lengthwise ends of the heater 37, in terms of the direction parallel to the generatrix of the film 36, to prevent them from moving in the thickness direction of the film 36. They are structured so that they allow the lengthwise ends of the heater 37 to move in the direction parallel to the surface of the substrate 37*a* of the heater 37, on which the film 36 slides. In other words, they are structured to prevent the problem that as the heater 37 is thermally expanded, and/or is deformed when it is subjected to pressure, or separated, it is unnecessarily subjected to stress.

In this embodiment, an end support surface 38*b* of the supporting member 38, to which the heater 37 is held by the power supply connector 46 and the clip 47, is 7.0 mm in width. In terms of the direction parallel to the generatrix of the film 36, the end E of this end support surface 38*b* is on the outward side of the nip N formed by the pressure roller 32, and is 15.0 mm apart from the position D of the pressure application area of the pressure roller 32. The dimension of the end support surface 38*b*, in terms of the thickness direction of the heater 37, is 0.3 mm.

Figure 8:
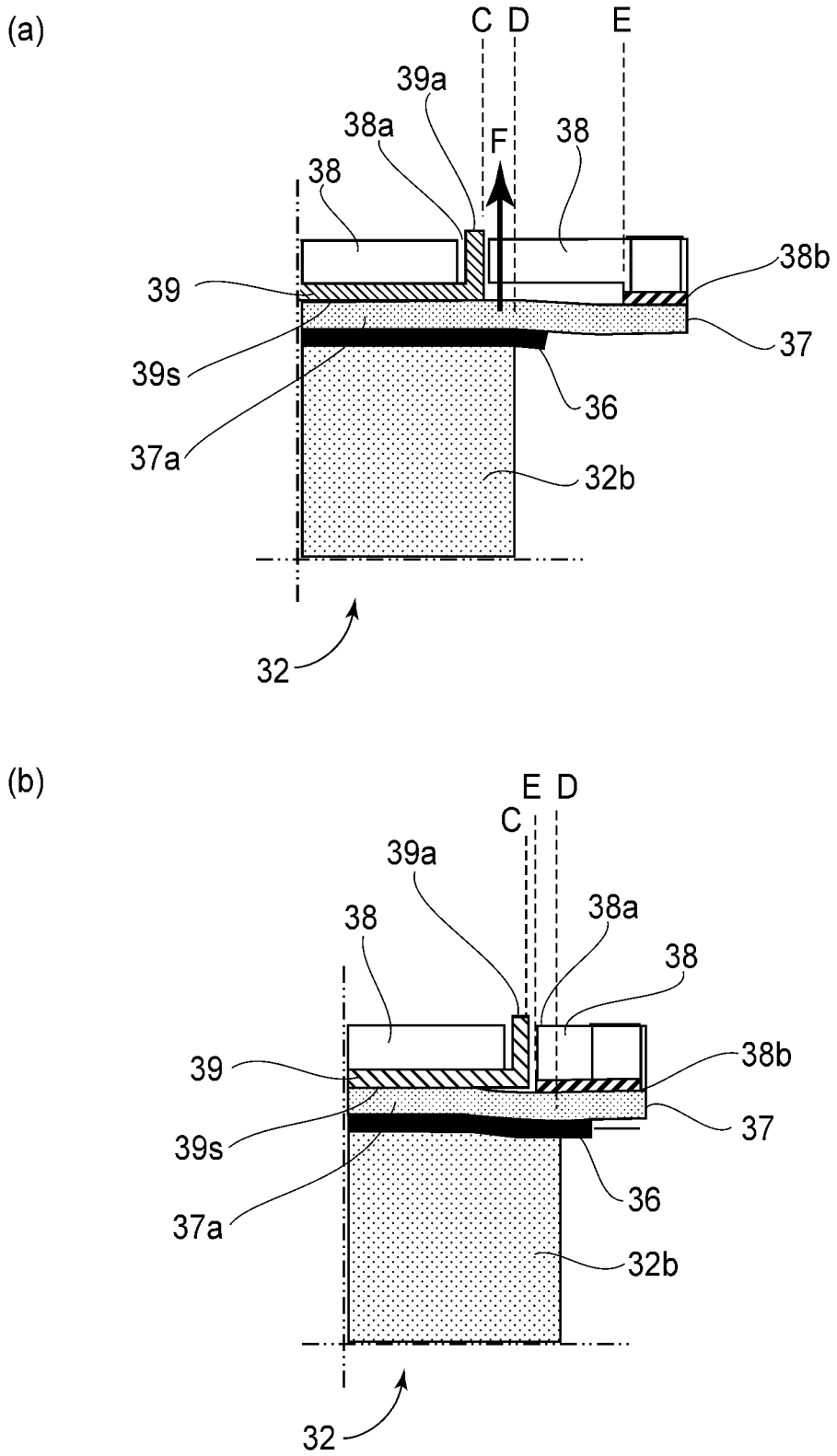
FIG. 8(*a*) is a drawing for illustrating the state of contact between the heater and thermally conductive member of the fixing device in the first embodiment, in the adjacencies of one of the lengthwise ends of the thermally conductive member.

Next, referring to FIG. 8, the mechanism which ensures that the heater 37 and thermally conductive member 39 remain in contact with each other at their lengthwise ends, regardless of the component tolerance of the fixing device 30, is described.

FIG. 8(*a*) is a drawing for illustrating the state of contact between the end portion of the thermally conductive member 39, and the heater 37, at one of the lengthwise ends of the heater 37, in the fixing device 30 in this embodiment. FIG. 8(*b*) is a drawing for illustrating the state of contact between the end portion of the thermally conductive member 39, and the heater 37, at one of the lengthwise end portions of the heater 37, in the comparative fixing device 30. In FIG. 8(*b*), the power supply connector 46 is not shown for descriptive discretion.

In this embodiment, in terms of the lengthwise direction of the heater 37, the center portion of the heater 37 is in contact with the thermally conductive member 39, being thereby supported by the thermally conductive member 39. The contact surface 38*b* of the supporting member 38 protrudes by 0.3 mm toward the pressure roller 32, relative to a surface 38*s* (FIG. 5(*c*)) of the supporting member 38, which is in contact with the thermally conductive member 39, whereas the thermally conductive member 39 is 0.3 mm in thickness. Thus, if the components of the fixing device 30 have no error in their dimensions, the end support surface 38*b* will be level with the surface 39*s* of the thermally conductive member 39, which is in contact with the heater 37, as shown in FIG. 5(*c*).

Next, referring to FIG. 8(*a*), a case in which the contact surface 38*b* of the supporting member 38 protrudes by 0.1 mm toward the pressure roller 32 relative to the surface 39*s* of the thermally conductive member 39, which is in contact with the heater 37, because of component tolerance, that is, there is a step between the two surfaces 38*b* and 39*s*, is discussed.

FIG. 8(*b*) shows the structure of a comparative fixing device, which is structured so that the outward end C of the thermally conductive member 39 is on the inward side of the end D of the pressure application area of the pressure roller 32, and the inward end E of the area 38*b* of contact of the supporting member 38 is between the outward end C of the thermally conductive member 39, and the end D of the nip N. Referring to FIG. 8(*b*), the area 38*b* of contact of the supporting member 38 causes the heater 37 to deform toward the pressure roller 32. This deformation sometimes reaches as far as the area of the heater 37, which corresponds in position to the end C of the thermally conductive member 39, causing the heater 37 to separate from the thermally conductive member 39. This separation of the end portion of the thermally conductive member 39 from the heater 37 is problematic in that it makes it impossible for the thermally conductive member 39 to make satisfactorily uniform in the amount of heat, the portion of the heater 37, which corresponds to the end portion of the thermally conductive member 39, in terms of the lengthwise direction of the thermally conductive member 39.

Next, referring to FIG. 8(*a*), a case in which the aforementioned step occurred in the fixing device 30, described with reference to FIG. 5(*c*), is described. As the heater 37 is pressed by the contact surface 38*b* toward the pressure roller 32, it deforms as if it rotates about the end D of the nip N. One of the reasons for the occurrence of this rotational deformation is that the fixing device 30 is structured so that the area (first area) of the supporting member 38, which is between the end C and end E, does not contact the second surface of the heater 37, and therefore, is likely to be easily deformed. The second reason is that on the inward side of the end D of the nip N, the heater 37 is subjected to a force F, shown in FIG. 8(*a*), being enabled to resist the force which works in the direction to deform the heater 37, whereas on the outward side of the end D, it is not subjected to the force F, being thereby likely to be easily deformed. Thus, the deformation of the heater 37 does not reach to the portion of the heater 37, which corresponds in position to the end C of the thermally conductive member 39. Therefore, it is ensured that the end portion of the thermally conductive member 39, and the heater 37, remain in contact with each other. By the way, in FIG. 8(*a*), the end C of the thermally conductive member 39 is positioned on the inward side of the end D of the nip N, in consideration of the tolerance in component dimension. However, the fixing device 30 may be structured so that the end C coincides with the end D.

As described above, according to this embodiment, it is possible to ensure that the heater 37 and the thermally conductive member 39 remain in a better state of contact with each other regardless of the tolerance in component dimension. In other words, this embodiment is effective to keep the heater 37 uniform in temperature.

In this embodiment, the thermally conductive member 39 is a single piece of thermally conductive substance. However, it may be made up of multiple pieces of thermally conductive substance.

Figure 13:
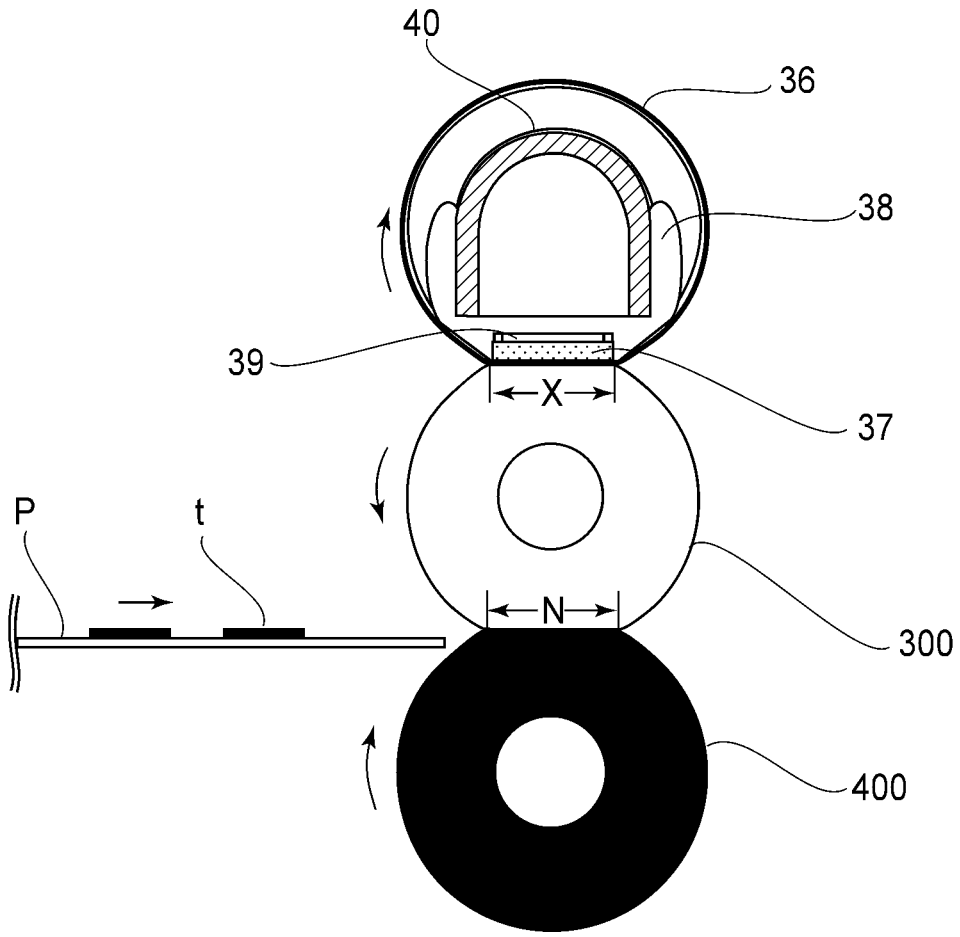
FIG. 13 is a schematic sectional view of one of the modified versions of the fixing device in the first embodiment.

Further, in this embodiment, the fixing device 30 is structured so that the heater 37 forms the nip N, with the pressure roller 32, with the presence of the film 36 between itself and the pressure roller 32. However, the fixing device 30 may be structured so that the heater 37 and a fixation roller 300 form a heating-pressing portion X, with the presence of the film 36 between the heater 37 and the fixation roller 300 (modified version of first embodiment) as shown in FIG. 13. In the case of this modified version of the first embodiment, the fixation roller 300 is heated by the film 36, in the heating-pressing portion X, and the fixation roller 300 is placed in contact with the pressure roller 400 to form the nip N through which recording medium is conveyed.

Embodiment 2

Next, another example of fixing device 30 in accordance with the present invention is described. The fixing device 30 in this embodiment is the same in structure as the fixing device 30 in the first embodiment, except for the structure of its pressure roller 32.

Figure 10:
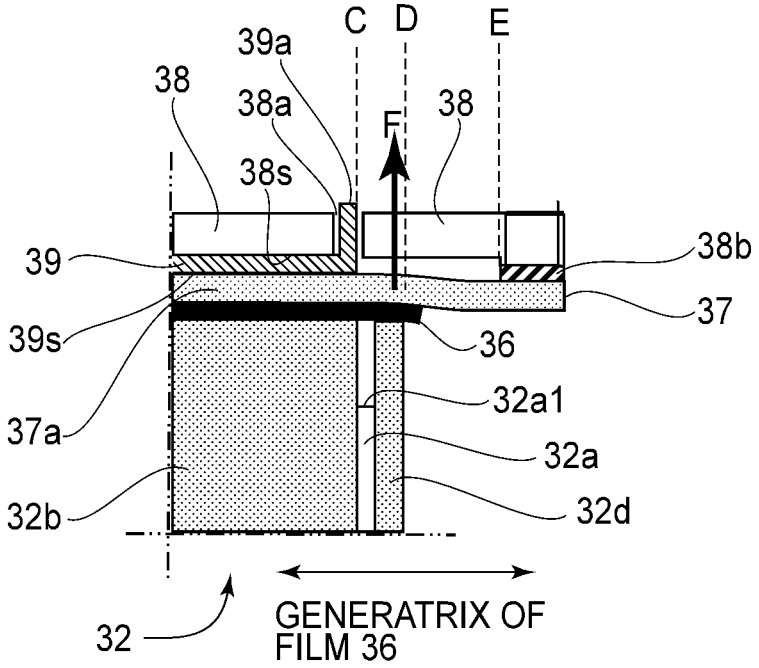
FIG. 10 is a drawing illustrating the characteristic features of the fixing device in the second embodiment of the present invention.
Figure 11:
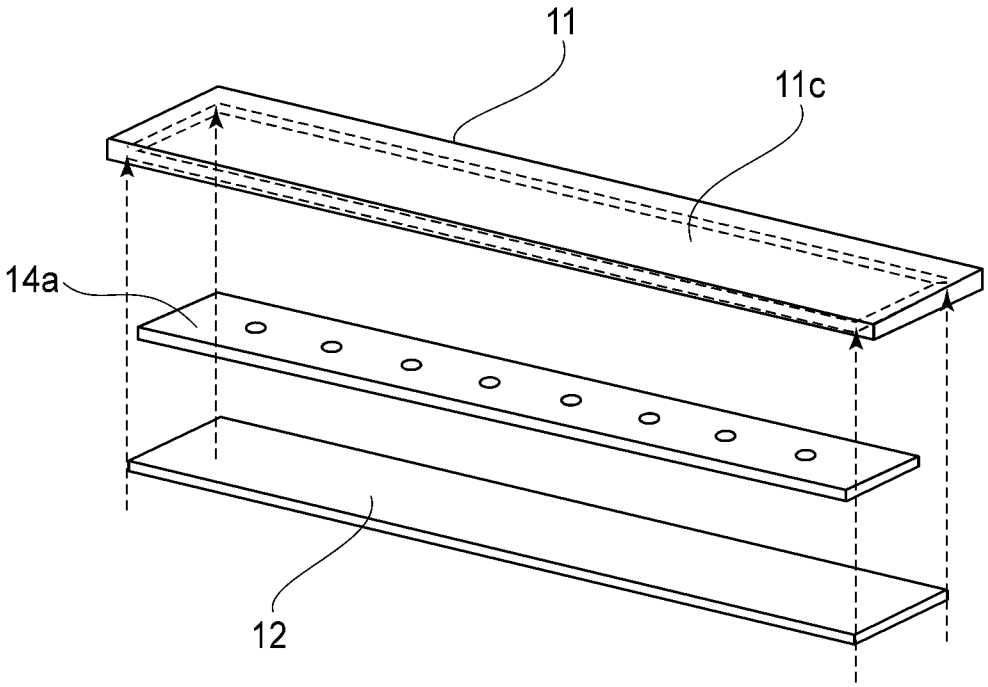
FIG. 11 is a drawing illustrating the structure of the heater and thermally conductive member of a fixing device in accordance with the prior art.

FIG. 10 is a drawing for illustrating the characteristic features of the fixing device 30 in this embodiment, more specifically, the positional relationship among its supporting member 38, the thermally conductive member 39, the heater 37, the film 36, and the lengthwise end of the pressure roller 32. In FIG. 10, the power supply connector 46 is not shown for descriptive discretion.

Referring to FIG. 10, the pressure roller 32 is provided with a rubber ring 32*d*, as the second opposing member, which is on the outward side of the elastic layer 32*b* (first opposing member) for forming the nip N. In terms of the lengthwise direction, a gap 32*a*1 is provided between the elastic layer 32*b* and rubber ring 32*d*. The rubber ring 32*d* is the same in material as the elastic layer 32*b*. It is 18 mm in external diameter, and 5 mm in width. The rubber ring 32*d* presses on the heater 37, between the outward end C of the thermally conductive member 39, and the inward end E of the contact surface 38*b*. Therefore, the heater 37 is subjected to a force F shown in FIG. 10. This force F can prevent the heater 37 from deforming in the adjacencies of the end C of the thermally conductive member 39, and therefore, can improve the fixing device 30 in the state of contact between the heater 37 and thermally conductive member 39 across the lengthwise end portion of the thermally conductive member 39.

In terms of the lengthwise direction, the end C of the thermally conductive member 39 is the same in position as the end of the nip N (elastic layer 32*b*), or on the inward side of the end of the nip N (elastic layer 32*b*). Further, the supporting member 38 has the first area which extends from the end C of the thermally conductive member 39 to the outward side of the end D of the rubber ring 32*d*, and the second area which is in contact with the second surface, on the outward side of the first area. Here, the "second surface" means the opposite surface of the heater 37 from the surface of the heater 37, which is in contact with the film 36.

In the case of the fixing device 30 in this embodiment, the pressure roller 32 is provided with the rubber ring 32*d* in addition to the elastic layer 32*b*. Therefore, it is ensured that the heater 37 remains in a better state of contact with the thermally conductive member 39. Also in the case of the fixing device 30 in this embodiment, the amount of the force F for preventing the deformation of the heater 37 can be optionally set by adjusting the rubber ring 32*d* in external diameter. In other words, even if the tolerance set for the components of the fixing device 30 is relatively large, the state of contact between the heater 37 and the thermally conductive member 39 can be improved by adjusting the external diameter of the rubber ring 32*d*.

The characteristic effects of the fixing device 30 in this embodiment are as follows: The heat from the heater 37 is likely to escape from the lengthwise ends of the pressure roller 32, through the parting layer 32*c* (surface layer), the elastic layer 32*b*, and the metallic core 32*a*. Thus, if the elastic layer 32*b* of the pressure roller 32 is simply increased in size in the lengthwise direction to form the rubber ring 32*d*, it is likely for the portions of the heater 37, which correspond in position to the lengthwise end portions of the pressure roller 32, to decrease in temperature, and therefore, it is possible that the portions of the toner image, which are on the lateral edge portion of a sheet of the recording medium, will be unsatisfactorily fixed.

In comparison, in the case of the fixing device 30 in this embodiment, the gap 32*a*1 is provided between the elastic layer 32*b* and the rubber ring 32*d* of the pressure roller 32. That is, the elastic layer 32*b* and the rubber ring 32*d* are not in contact with each other. Therefore, this structural arrangement makes it more difficult for the heat in the lengthwise end portions of the elastic layer 32*b* to escape than the structural arrangement which simply extends the elastic layer 32*b*. Therefore, it makes it less likely for the lengthwise end portions of the heater 37 to decrease in temperature.

As described above, this embodiment can keep the heater 37 and the thermally conductive member 39 in the better state of contact with each other to minimize the temperature reduction which occurs to the lengthwise end portions of the heater 37. That is, it is more effective to keep the heater 37 uniform in temperature in terms of the lengthwise direction.

Incidentally, instead of providing the gap 32*a*1 as in this embodiment, the portion of the metallic core 32*a*, which corresponds to the gap 32*a*1, may be increased in external diameter to provide a portion like a stair step.

Embodiment 3

Figure 9:
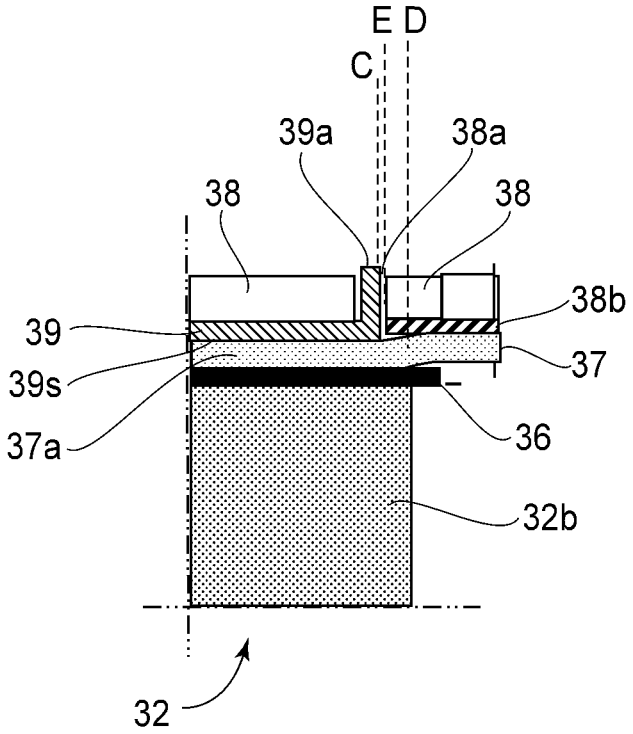
FIG. 9 is a drawing which shows the structure of the heater, the supporting member, the thermally conductive member, and the pressure roller of the fixing device in the third embodiment of the present invention, in the adjacencies of one of the lengthwise end portions of the fixing device.

The fixing device in this embodiment is the same in structure as the one in the first embodiment, except for its portions which are described next. Therefore, the general structure of this fixing device is not described. FIG. 9 is a drawing of one of the lengthwise end portions of another modified version of the fixing device 30 in the first embodiment. It is for illustrating the positional relationship among the supporting member 38, the thermally conductive member 39, the heater 37, the film 36, and the pressure roller 32, at one of the lengthwise ends of the fixing device. In FIG. 9, the power supply connector 46 is not shown for descriptive discretion.

The fixing device 30 structured so that the inward end E of the contact surface 38*b* (second area) of the supporting member 38 is between the end C of the thermally conductive member 39 and the end D of the nip N may be modified in structure as follows.

Referring to FIG. 9, it may be structured so that the contact surface 38*b* of the supporting member 38 is offset from the area of contact between the thermally conductive member 39 and the heater 37. This structural arrangement can absorb the component tolerance by the offset, and therefore, can ensure that the heater 37 remains in the better state of contact with the thermally conductive member 39.

As described above, the fixing device 30 in this embodiment can ensure that the heater 37 remains in contact with the thermally conductive member 39 regardless of component tolerance. Therefore, it is greater in its effectiveness to keep the heater 37 uniform in temperature with the use of the thermally conductive member 39.

By the way, the fixing devices in the first, second, and third embodiments were for heating the unfixed toner image t on the sheet P of a recording medium to fix the toner image to the sheet P. However, the present invention is also applicable to an image heating device for heating a fixed image on a sheet P of a recording medium to increase the image in gloss.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 151617/2013 and 128147/2014 filed Jul. 22, 2013 and Jun. 23, 2014, respectively, which are hereby incorporated by reference.

What is claimed is:

1. A fixing device for fixing a toner image formed on a recording material, on a recording material, said fixing device comprising:

a cylindrical film;

a heater having a first surface contacting an inner surface of said film;

an opposed member cooperating with said heater to form a press-contact portion with said film interposed therebetween;

a supporting member configured to support a second surface of said heater opposite the first surface; and a heat conduction member contacting said second surface, wherein with respect to a generatrix direction of said film, an end portion of a contact region between said heat conduction member and said second surface is at or inside an end portion of said press-contact portion, and wherein in a region from an the end portion of the contact region to an outside of the end portion of said press-contact portion with respect to the generatrix direction, said supporting member includes a first region not contacting said second surface and a second region contacting said second surface outside said first region.

2. The apparatus according to claim 1, wherein said heater includes a substrate and a heat generating resistor on said substrate, and said heat conduction member has a thermal conductivity higher than that of said substrate.

3. The apparatus according to claim 1, wherein said supporting member is out of contact with said second surface except for the second region.

4. The apparatus according to claim 1, wherein said press-contact portion provides a nip for feeding the recording material.

5. The apparatus according to claim 1, further comprising a pressure member, wherein said opposed member is in the form of a roller, and said pressure member provides a nip for feeding the recording material in contact with a portion of said roller different from a portion contacted by said film.

6. The apparatus according to claim 1, wherein said heat conduction member is made of metal or graphite.

7. The apparatus according to claim 1, further comprising a reinforcing member, wherein said reinforcing member contacts a side of said supporting member opposite a surface contacting said heat conduction member to reinforce said supporting member.

8. The apparatus according to claim 7, wherein with respect to the generatrix direction, an end portion the of the region of said reinforcing member contacting said supporting member is outside the end portion of said press-contact portion.

9. A fixing device for fixing a toner image formed on a recording material, on a recording material, said fixing device comprising:

a cylindrical film;

a heater having a first surface contacting an inner surface of said film;

a first opposed member cooperating with said heater to form a first press-contact portion with said film interposed therebetween;

a second opposed member cooperating with said heater to form a second press-contact portion with said film interposed therebetween, said second opposed member being outside of an end portion of said first opposed member with respect to the generatrix direction and being out of contact with an end portion of said first opposed member;

a supporting member configured to support a second surface of said heater opposite the first surface; and a heat conduction member contacting said second surface, wherein with respect to a generatrix direction of said film, an end portion of a contact region between said heat conduction member and said second surface is at or inside an end portion of said first press-contact portion, and wherein in a region from the end portion of the contact region to an outside of an end portion of said second press-contact portion with respect to the generatrix direction, said supporting member includes a first region not contacting said second surface and a second region contacting said second surface outside said first region.

10. The apparatus according to claim 9, wherein said first opposed member is a first portion and said second opposed member is a second rotatable portion co-axial with said first rotatable portion.

* * * * *